US010634318B2

(12) United States Patent
Harper

(10) Patent No.: US 10,634,318 B2
(45) Date of Patent: Apr. 28, 2020

(54) LANDSCAPE LIGHTING ASSEMBLY HAVING STACKABLE GOBO SECTIONS

(71) Applicant: Volt, LLC, Tampa, FL (US)

(72) Inventor: Jesse Daniel Harper, Wesley Chapel, FL (US)

(73) Assignee: Volt, LLC, Tampa, FL (US)

( * ) Notice: Subject to any disclaimer, the term of this patent is extended or adjusted under 35 U.S.C. 154(b) by 0 days.

(21) Appl. No.: 16/111,301

(22) Filed: Aug. 24, 2018

(65) Prior Publication Data

US 2019/0078761 A1 Mar. 14, 2019

Related U.S. Application Data

(60) Provisional application No. 62/558,525, filed on Sep. 14, 2017.

(51) Int. Cl.
*F21W 131/10* (2006.01)
*F21V 17/00* (2006.01)
(Continued)

(52) U.S. Cl.
CPC ..... *F21V 17/002* (2013.01); *F21S 8/083* (2013.01); *F21V 11/06* (2013.01); *F21V 23/001* (2013.01); *F21V 23/02* (2013.01); *F21V 1/24* (2013.01); *F21V 23/06* (2013.01); *F21W 2121/00* (2013.01); *F21W 2131/10* (2013.01)

(58) Field of Classification Search
CPC .. F21S 8/032; F21S 8/083; F21S 6/00; F21W 2121/00; F21W 2131/10; F21W 2131/109; F21V 11/00; F21V 23/001; F21V 23/002; F21V 1/00; F21V 23/06; F21V 11/08; F21V 21/08; F21V 27/02; F21V 17/002; F21V 11/06; F21V 23/02; F21V 1/24;
(Continued)

(56) References Cited

U.S. PATENT DOCUMENTS 3,218,446 A * 11/1965 Langer ..... F21S 2/005 362/260
3,777,138 A * 12/1973 Metzler ..... F21V 21/116 362/235
(Continued)

OTHER PUBLICATIONS

"Volt 26" Scroll Tower Bollard Light 4' Lead Wire Aluminum Black webpage accessed at https://www.voltlighting.com/outdoor-landscape-lighting-12v-bollard-path-area-light-scroll-26-bz/p/vpl-1017-26-4-abz on Apr. 13, 2017, all enclosed pages cited.
(Continued)

*Primary Examiner* — Anh T Mai
*Assistant Examiner* — Fatima N Farokhrooz
(74) *Attorney, Agent, or Firm* — Nelson Mullins Riley & Scarborough, LLP

(57) ABSTRACT

A lighting assembly is provided including a base configured to support the lighting assembly, a plurality of gobo sections configured to be vertically stacked upon the base, at least one illumination element located internal to the lighting assembly, such that light from the at least one illumination element is cast through at least one of the plurality of gobo sections, and an assembly top configured to enclose a top side of an upper most gobo section of the plurality of gobo sections. The base and the plurality of gobo sections comprises complementary alignment couplings that are removably connected when stacked.

20 Claims, 10 Drawing Sheets

(51) Int. Cl.

| | |
|---|---|
| ***F21V 11/06*** | (2006.01) |
| ***F21V 23/00*** | (2015.01) |
| ***F21V 23/02*** | (2006.01) |
| ***F21S 8/08*** | (2006.01) |
| *F21V 23/06* | (2006.01) |
| *F21W 121/00* | (2006.01) |
| *F21V 1/24* | (2006.01) |

(58) Field of Classification Search
CPC ..... A47F 5/10; A47F 3/004; F21Y 2115/10; Y10S 362/806
See application file for complete search history.

(56) References Cited

U.S. PATENT DOCUMENTS

| | | | | |
|---|---|---|---|---|
| 4,072,857 | A * | 2/1978 | DeVicaris | A41G 1/005 362/123 |
| 4,344,368 | A * | 8/1982 | Remington | B65D 19/0022 108/55.1 |
| D758,636 | S | 6/2016 | Breedlove, Sr. | |
| 9,488,320 | B1 * | 11/2016 | Palfreyman | H05B 33/0821 |
| 2006/0193124 | A1 * | 8/2006 | Moll | A47B 97/00 362/133 |
| 2007/0183138 | A1 * | 8/2007 | Cooper | F21V 21/03 362/147 |
| 2010/0001662 | A1 * | 1/2010 | Nelkin | F21S 8/065 315/294 |
| 2011/0018448 | A1 * | 1/2011 | Metchear, III | F21S 9/035 315/152 |
| 2013/0049609 | A1 * | 2/2013 | Browder | F21V 5/004 315/159 |
| 2015/0130351 | A1 * | 5/2015 | Braunstein | H05B 37/0227 315/86 |
| 2016/0146445 | A1 * | 5/2016 | Shine | F21V 23/06 362/234 |
| 2016/0186939 | A1 * | 6/2016 | Ho | F21K 9/65 362/101 |
| 2017/0059130 | A1 * | 3/2017 | Sittner | F21V 11/00 |
| 2017/0181539 | A1 * | 6/2017 | Linden | A47B 47/0091 |
| 2017/0224135 | A1 * | 8/2017 | Burns | F21V 23/06 |
| 2018/0168337 | A1 * | 6/2018 | Arriagada Lama | A47F 5/00 |
| 2019/0049096 | A1 | 2/2019 | Harper | |

OTHER PUBLICATIONS

"Volt 26" Leaf Tower Bollard Light 4' Lead Wire Aluminum Black webpage accessed at https://www.voltlighting.com/outdoor-landscape-lighting-12v-bollard-path-area-light-leaf-26-bz/p/vpl-1018-26-4-abz on Apr. 13, 2017, all enclosed pages cited.

"Welcome to Attraction Lights!" webpage accessed at http://attractionlights.com/ on Apr. 13, 2017, all enclosed pages cited.

"Volt Lighting Launches Shadowmaster Path & Area Light" Press Release issued Apr. 11, 2017, all enclosed pages cited.

* cited by examiner

LANDSCAPE LIGHTING ASSEMBLY HAVING STACKABLE GOBO SECTIONS

PRIORITY CLAIM

This application is based upon and claims priority to U.S. provisional application Ser. No. 62/558,525, filed Sep. 14, 2017. The aforementioned application is incorporated fully herein by reference in their entirety for all purposes.

FIELD OF THE INVENTION

The present invention relates generally to landscape lighting assemblies. More particularly, the present invention relates to a landscape lighting assembly having at least one stackable gobo section.

BACKGROUND

Lighting assemblies typically include an illumination element (i.e., a light of some sort) and a housing to contain the illumination element. In some instances, the housing may include one or more decorative features, such as etched panes, filigree styled arms, or the like. The decorative features may block some light causing the feature to contrast with the portions passing light.

Some lighting assemblies may be bollards, e.g. short vertical posts. These bollard lighting assemblies may be used throughout landscaping as accent lighting, or marking the edge of a features, such as a path. Bollard lighting assemblies come in a variety of predetermined heights for various applications. In some instances, the bollard lighting assemblies may include decorative features to enhance their aesthetic appeal.

A gobo (sometimes short for "goes before optics" or "graphical optical black out") may be used to cast a shadow. A gobo is a physical stencil (template) that is placed inside or in front of a light source, to control the pattern of the emitted light. They are often used with stage lighting instruments to manipulate the light pattern which is cast over a space or onto an object. A gobo with patterned holes allows only the desired pattern of light through, casting a specific shadow pattern.

SUMMARY OF CERTAIN ASPECTS

The present invention recognizes and addresses the foregoing considerations, and others, of prior art construction and methods. In this regard, certain exemplary and non-limiting aspects of the present invention will now be described. These aspects are intended to provide some context for certain principles associated with the present invention, but are not intended to be defining of the full scope of the present invention.

In an example embodiment, a lighting assembly is provided including a base configured to support the lighting assembly, a plurality of gobo sections configured to be vertically stacked upon the base, at least one illumination element located internal to the lighting assembly, such that light from the at least one illumination element is cast through at least one of the plurality of gobo sections, and an assembly top configured to enclose a top side of an uppermost gobo section of the plurality of gobo sections. The base and the plurality of gobo sections comprises complementary alignment couplings that are removably connected when stacked.

In some example embodiments, the lighting assembly may be further configured for optional modifications. In this regard, for example, each of the plurality of gobo sections include an integral electrical cable. In some example embodiments, electrical connectors are disposed at each end of the each of the integral electrical cables. In an example embodiment, the base includes a power supply electrically connected to a base electrical connector and the electrical connectors of the plurality of gobo sections are configured to electrically connect with the base electrical connector, or another electrical connector of another gobo section of the plurality of gobo sections, when stacked on the base or another gobo section. In some example embodiments, the electrical connectors and base electrical connector are disposed in the complementary alignment couplings. In an example embodiments, the illumination element comprises a lighting cable and a lamp jack. The lamp jack is configured to electrically connect to the electrical connectors to provide electrical power to the illumination element.

In some example embodiments, each of the gobo sections includes a support frame configured to support one or more gobo panes. The support frames are further configured to support the integral electrical cables. In an example embodiment, the support frame includes at least one vertical support and the integral electrical cable is disposed at least partially within the vertical support.

In an example embodiment, the lighting assembly also includes at least one lighting bracket configured to support the at least one illumination element and the lighting bracket is configured to be mounted to the base or one of the plurality of gobo sections. In some example embodiments, the at least one illumination element comprises a plurality of illumination elements and the at least one lighting bracket comprises a plurality of lighting brackets, each of the plurality of lighting brackets being attached to at least one of the plurality of illumination elements.

In some example embodiments, each gobo section includes at least one gobo pane. In an example embodiment, the at least one of gobo pane comprises a decorative pattern configured to cause a shadow of the decorative pattern to be cast on a surface when the illumination element is lighted. In some example embodiments, two or more of the plurality of gobo panes of a gobo section includes the same decorative pattern. In an example embodiment, at least one gobo pane of at least one gobo section includes a blank configured to prevent light from passing through the gobo pane.

In an example embodiment, each of the gobo sections includes a support frame configured to retain the at least one gobo pane. In some example embodiments, the support frame includes a lower retention element, an upper retention element, and a plurality of vertical supports. The vertical supports extend between the lower retention element and the upper retention element. In an example embodiment, the vertical supports or the upper retention element and lower retention elements define a retention channel to retain the at least one gobo pane. In some example embodiments, the base also includes a mounting plate configured to receive one or more fasteners through mounting apertures to mount the base to a surface.

In some example embodiments, the assembly top also includes a top retention element configured to be mounted to the top side of the upper most gobo section of the plurality of gobo sections.

Additional embodiments of the present invention utilize various combinations of the disclosed elements as supported by the overall disclosure herein. Thus, combinations of elements other than those discussed above may be claimed.

Moreover, the accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
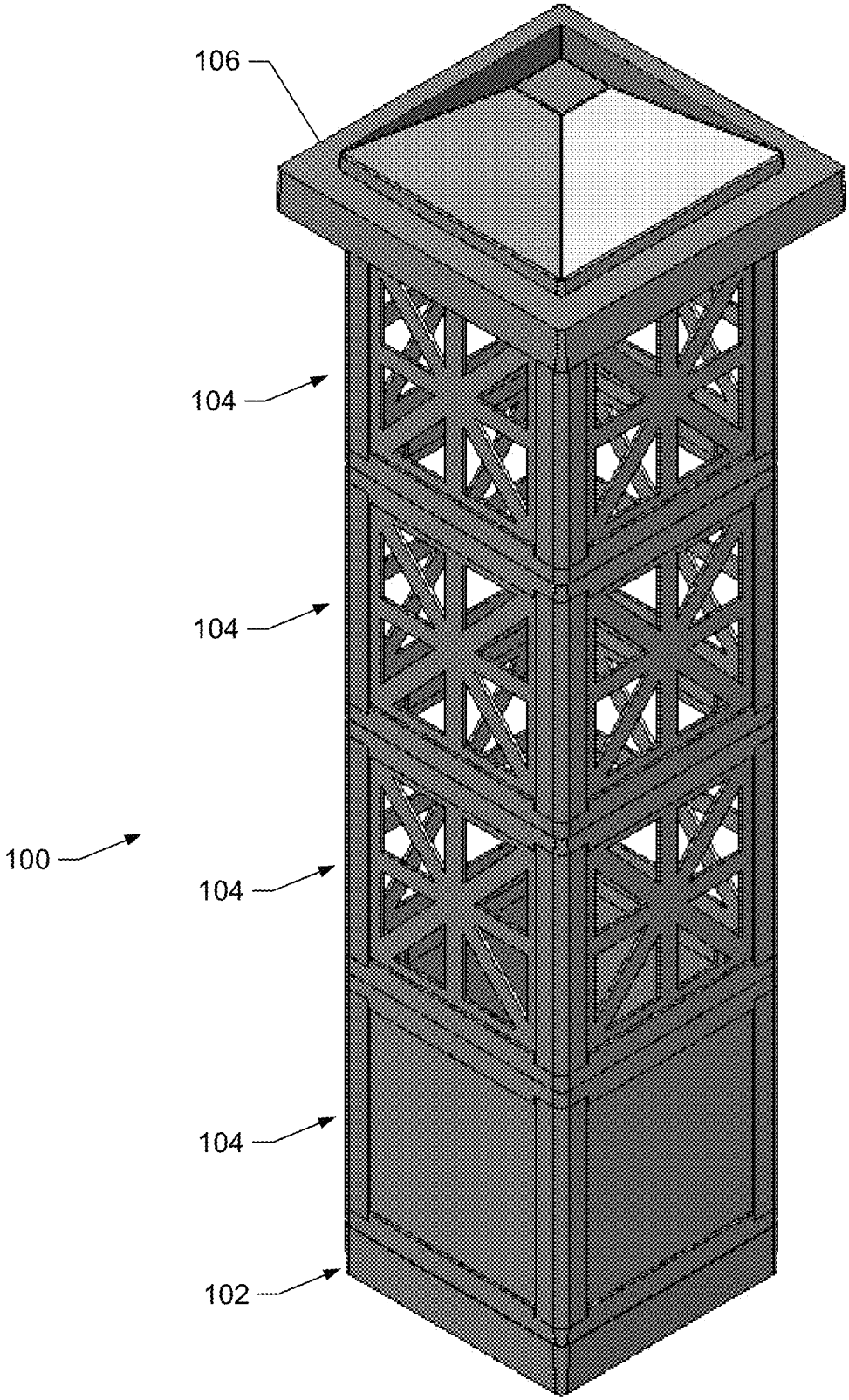
FIG. 1 illustrates a perspective view of a lighting assembly according to an example embodiment.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, terms referring to a direction or a position relative to the orientation of the lighting assembly, such as but not limited to "vertical," "horizontal," "upper," "lower," "front," or "rear," refer to directions and relative positions with respect to the lighting assembly's orientation in its normal intended operation, as indicated in the Figures herein. Thus, for instance, the terms "vertical" and "upper" refer to the vertical direction and relative upper position in the perspectives of the Figures and should be understood in that context, even with respect to an apparatus that may be disposed in a different orientation.

In an example embodiment, a lighting assembly is provided including a plurality of stackable gobo sections. The stackable gobo sections may enable a bollard lighting assembly to be assembled in a variety of heights to better accommodate the various applications of landscape lighting or interior decorative lighting. The gobo sections may also be removable, such as pulled apart, without tools, enabling the bollard lighting assemblies to be restacked at different heights. Further, gobo sections may include different and interchangeable gobo panes, which in turn cast different shadows. Since, the gobo sections are easily stacked in a different arrangements so that a variety of unique bollard lighting assembly arrangements may be formed.

In some embodiments, the electrical cabling for the lighting assembly is integral to the base and gobo sections. For example, the base and gobo sections may include plugs that make an electrical connection when stacked. In one such example, the electrical connections form a portion of complementary interference fit coupling between the base and the various gobo sections. In other words, the gobo sections plug into the next lower portion of the lighting assembly, thus allowing the illumination element to be powered at the desired height simply by plugging into the next lower portion of the lighting assembly. This "plug and play" design may relieve any need to rewire a lighting assembly to achieve a different height.

FIG. 1 illustrates a perspective view of a lighting assembly 100 according to an example embodiment. The lighting assembly 100 may include an illumination element 110 (FIG. 2), such as one or more light emitting diodes (LEDs), incandescent lights, compact fluorescent lamps (CFLs), or the like. The illumination element 110 may be powered from a suitable power supply, such as electrical wiring connected with power remote from the lighting assembly, batteries, solar cells, or the like.

The lighting assembly 100 may include a base 102 configured to support the lighting assembly on a surface. The base 102 may be mounted to the surface to limit or prevent movement of the lighting assembly 100, such as by a mounting plate, a post penetrating the surface, adhesive, or other suitable methods. The lighting assembly 100 may also include a plurality of gobo sections 104 configured to be vertically stacked upon the base 102. As described in further detail below, the base 102 and each gobo section 104 may include complementary interference fit couplings that are removably connected when stacked. The removable connection may enable the removal, rearrangement, and/or addition of gobo sections 104, as necessary or desired, to achieve a selected height or aesthetically pleasing pattern.

The lighting assembly 100 may also include an assembly top 106, e.g., lid or roof, configured to enclose a top side of an uppermost gobo section 104. However, it is contemplated that the assembly top 106 may be removed in some installations in order to provide up lighting from one or more illumination elements 110.

Figure 2:
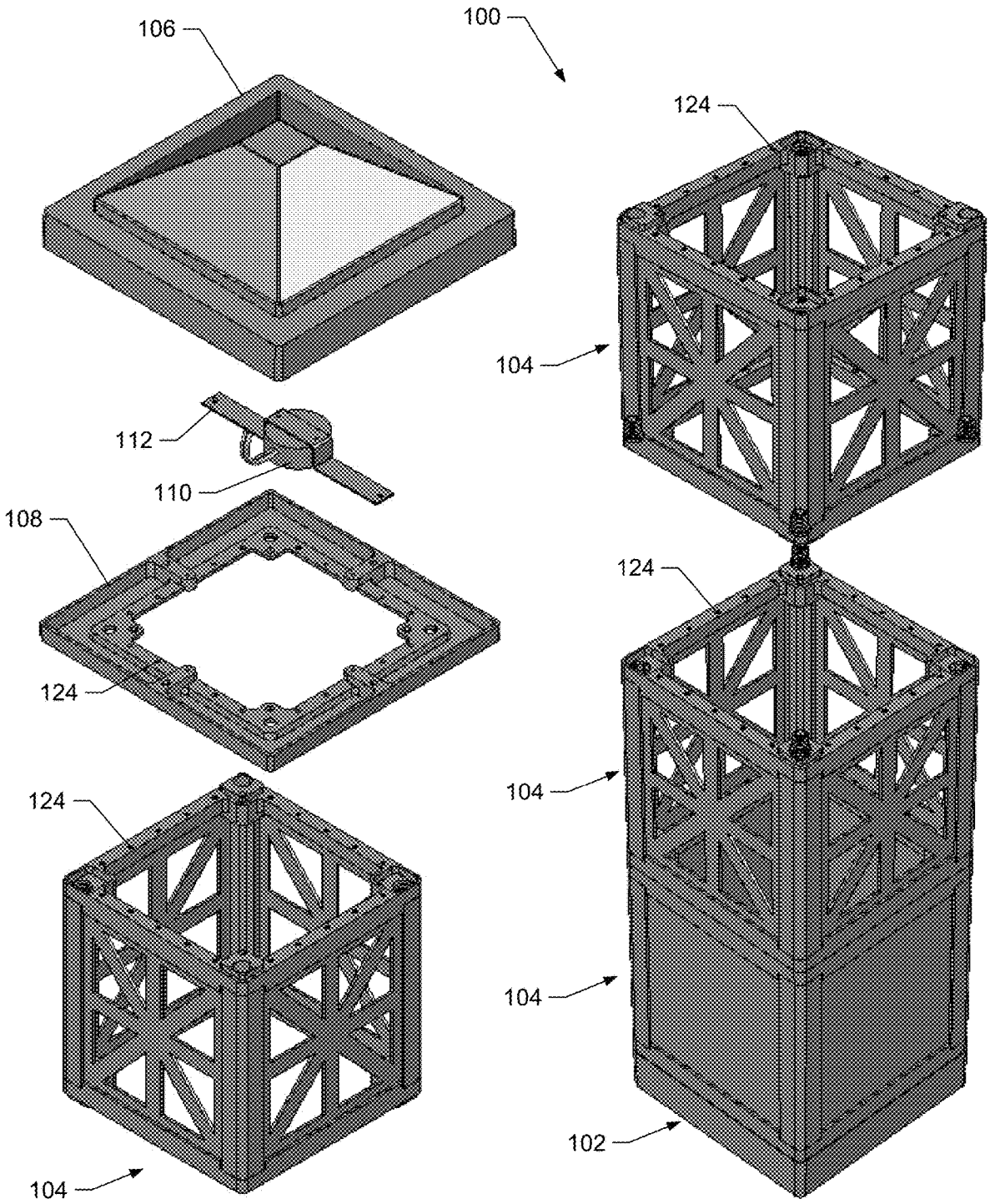
FIG. 2 illustrates a partially exploded view of the lighting assembly of FIG. 1 showing additional details.

FIG. 2 illustrates a partially exploded view of the lighting assembly 100. Particularly, the assembly top 106 and the two upper most gobo sections 104 are separated from the remainder of the structure to show additional details of the lighting assembly 100. The assembly top 106 may include a top retention element 108 configured to be mounted to the top side of the uppermost gobo section 104. The top retention element 108 may be mounted to the uppermost gobo section 104 by complementary interference fit couplings, similar to the connections between the base 102 and the various gobo sections 104. Additionally or alternatively, the top retention element 108 may be mounted to the uppermost gobo section 104 by one or more fasteners, adhesive, or other suitable method. The assembly top 106 may be formed such that an interior lip portion is complementary to an outer perimeter of the top retention element 108. The assembly top 106 may be mounted to the top retention element 108 by an interference fit, one or more fasteners, adhesive, or other suitable methods, or be held in position about the outer perimeter of the top retention element by gravity. The assembly top 106 may have a generally sloping upper face, which may advantageously direct rain, snow, and debris away from the lighting assembly 100. Additionally, the top retention element 108 may have a larger outer perimeter than the gobo sections 104 and/or the base 102, further limiting contact with rain, snow, or debris falling from the assembly top 106.

Figure 8:
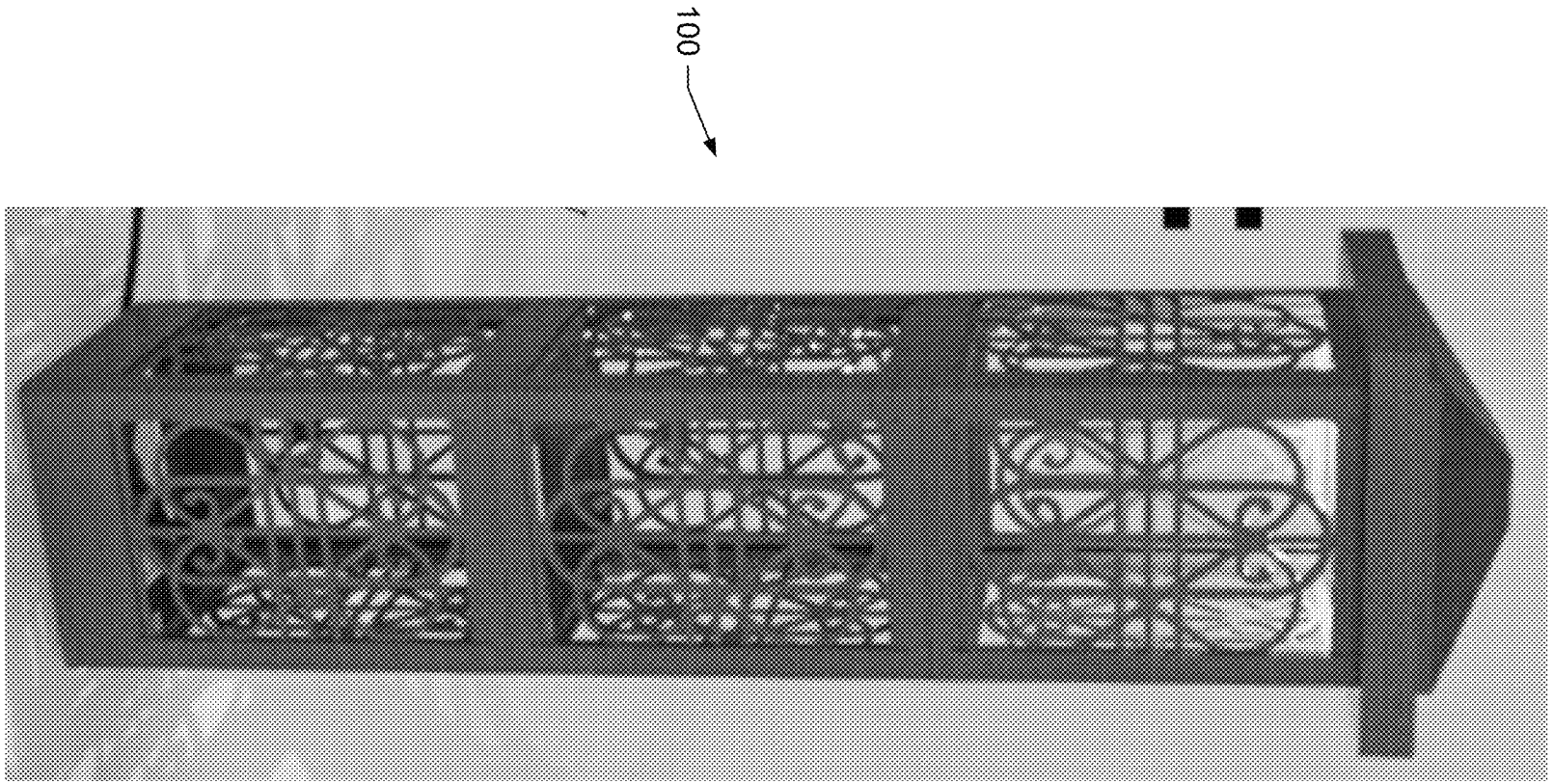
FIG. 8 illustrates a lighted lighting assembly according to an example embodiment.

In this embodiment, the illumination element 110 is attached to a lighting bracket 112 which is in turn mounted within lighting assembly 100. The lighting bracket 112 depicted in FIGS. 1 and 2 is mounted to top retention element 108 so as to create a downward and outward illumination pattern (similar to the lighted lighting assembly depicted in FIG. 8). One skilled in the art will understand, however, that the lighting bracket 112 and illumination element 110 may be mounted to any of the gobo sections 104 and/or the base 102 as necessary or desired. In addition, particularly when mounted to base 104 (see FIG. 3), illumination element 110 may be oriented so as to produce an upward and outward illumination pattern. Moreover, the lighting assembly 100 may include a plurality of lighting brackets 112 and/or illumination elements 110, such as mounted to the base 102 and the upper gobo section 104, mounted to alternating gobo sections 104, mounted to each gobo sections, or the like, some of which may be oriented (facing) downward and some of which may be oriented upward. Further, the lighting bracket 112 may be configured to have multiple illumination elements 110 mounted thereto. For example, the lighting bracket 112 may include mounting apertures for two or more illumination elements 110, which may be mounted facing in the same or opposing directions. It is also contemplated that the lighting bracket 112 may be formed such that illumination elements 110 may face sideways or at angles to increase the amount of light directed at each face of the gobo sections 104. In one example, the lighting bracket 112 may include one or more vertical extensions for mounting illumination elements 110 facing one or more of the faces of the gobo sections 104.

Figure 3:
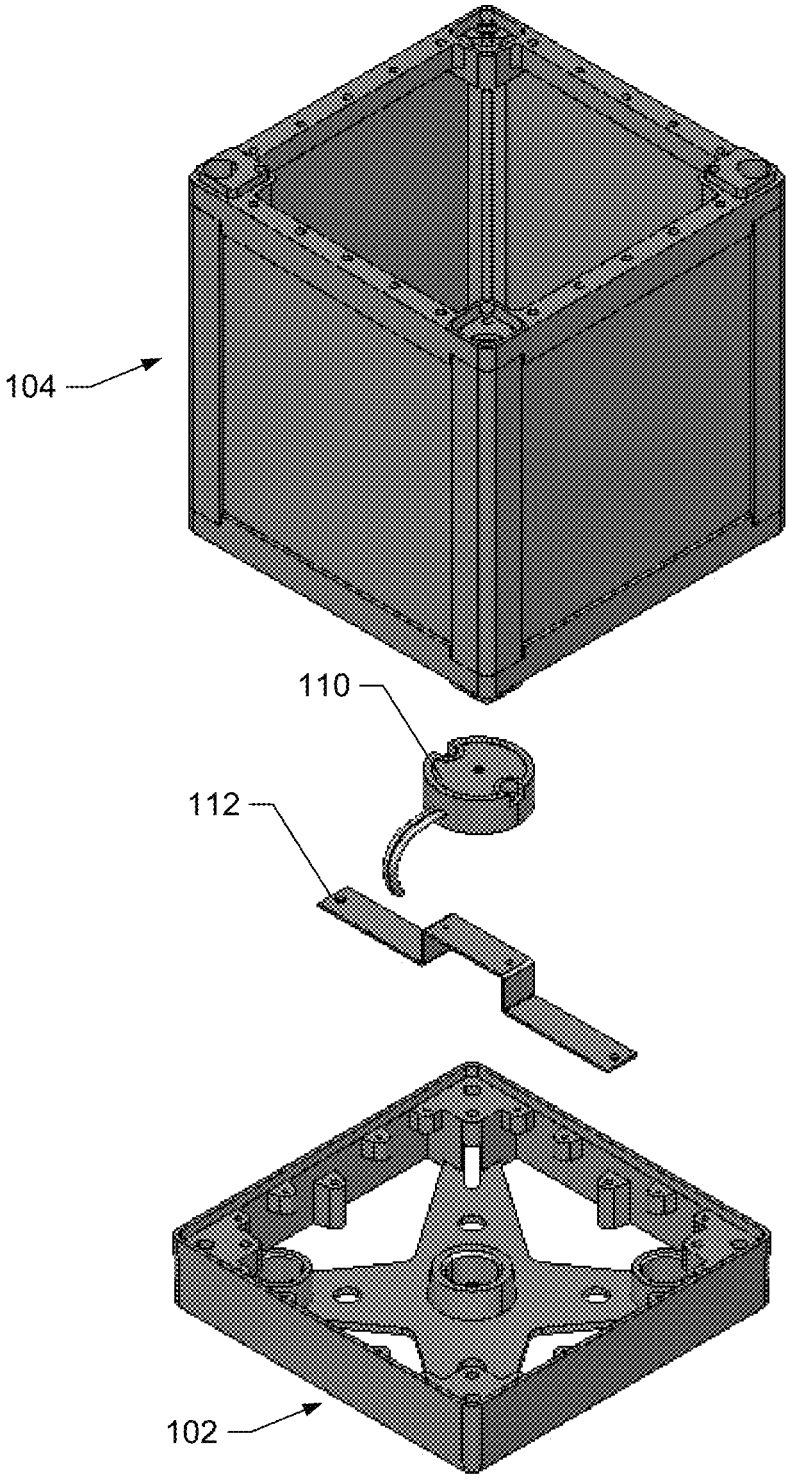
FIG. 3 illustrates an exploded view of a portion of the lighting assembly of FIG. 1.

FIG. 3 illustrates an exploded view of the bottom portion of the lighting assembly 100, particularly the base 102 and the bottommost gobo section 104. In the depicted embodiment, the lighting assembly 100 includes a second lighting bracket 112 and illumination element 110 mounted to the base 102. As will be discussed below in further detail, the bottom gobo section 104 of the depicted embodiment includes gobo panes which are "blanks," e.g., are configured to pass or block light without casting a shadow pattern. The blanks may be opaque, preventing light passage, translucent, allowing some light to pass or be colored, or may be transparent, allowing most or all of the light to pass.

Figure 4A:
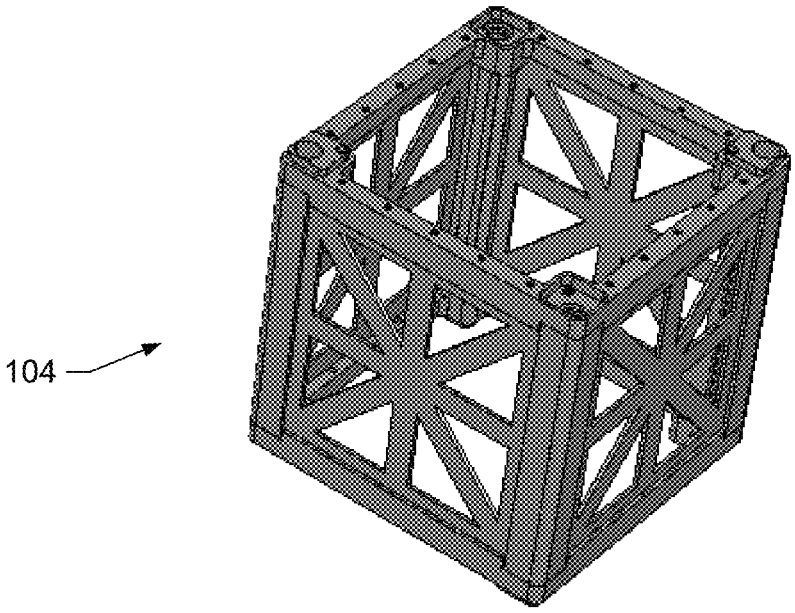
FIGS. 4A-4D assembled and exploded views of a gobo section or components thereof according to an example embodiment.
Figure 4B:
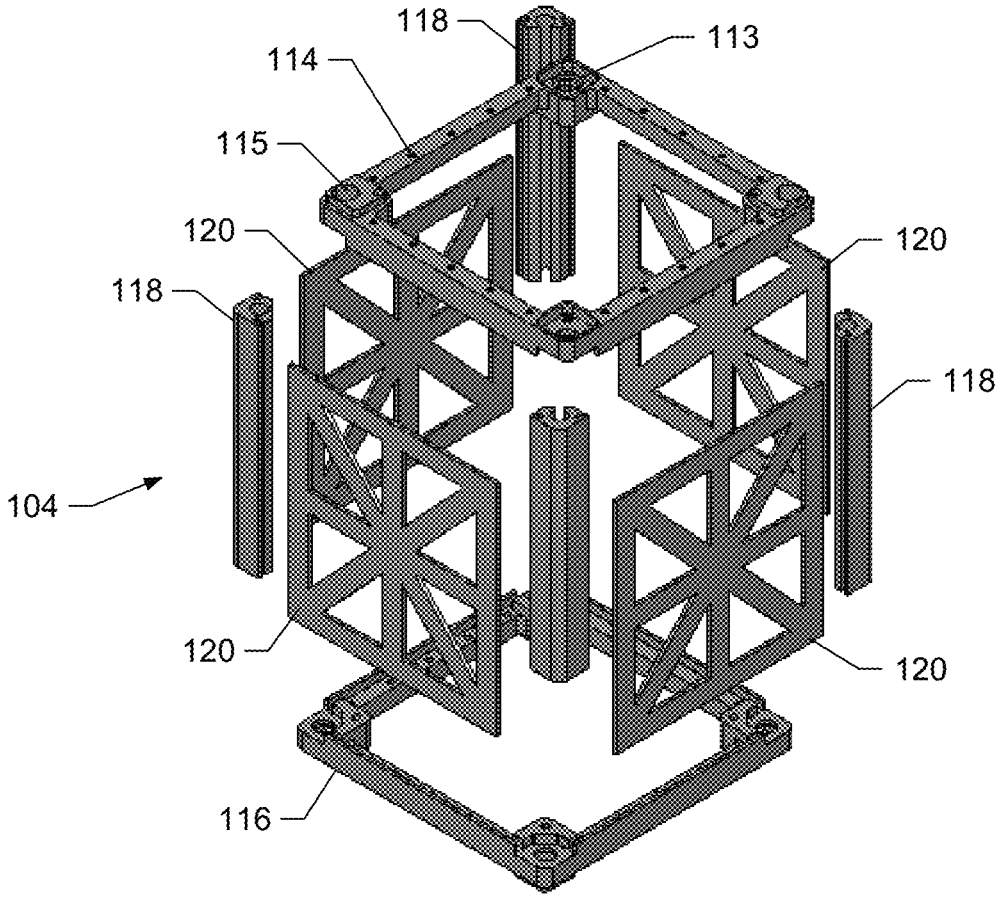

FIGS. 4A and 4B illustrate an assembled and exploded view of a gobo section 104, respectively. The gobo section 104 may include one or more gobo panes 120. The depicted gobo section 104 is substantially a cube with four square gobo panes 120. However, the gobo sections 104 may be formed in a variety of shapes, including but not limited to, cylinder, rectangular cuboid, triangular prism, pentagonal prism, hexagonal prism, or the like. The gobo sections 104 may include a gobo pane 120 for each exterior facing face. The gobo panes 120 may be formed from any suitable material, such as aluminum, steel, rigid plastic, or the like. In some embodiments, the gobo panes 120 may, additionally or alternatively, include a transparent or translucent element or window, such as glass, plastic, or the like.

Figure 9:
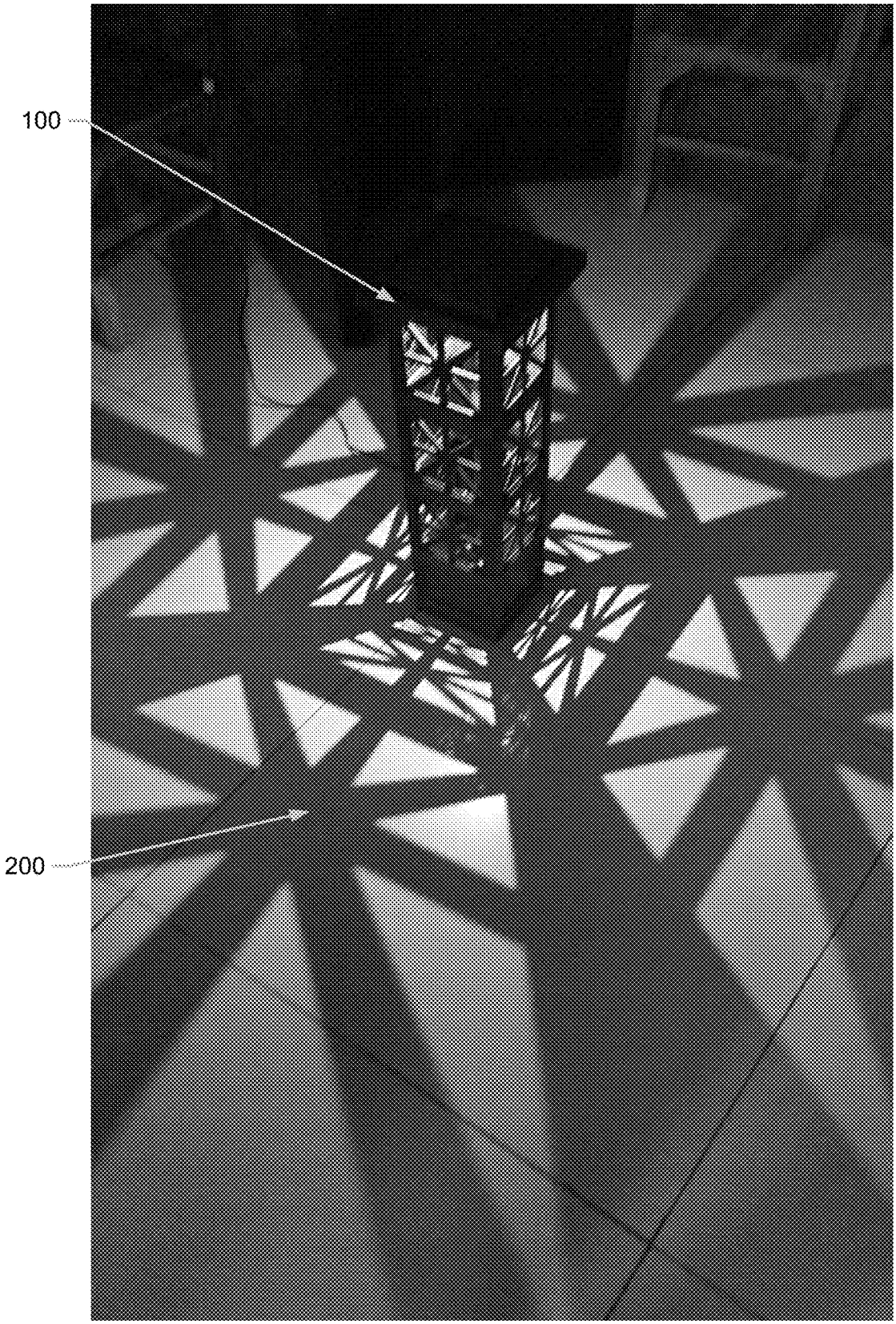
FIG. 9 illustrates shadow patterns cast by the lighting assembly according to an example embodiment.

The gobo panes 120 are generally configured to cast a shadow pattern on surrounding surface(s). Such gobo panes 120 may preferably comprise a patterned template (e.g., a filigree template, line template, or other suitable pattern) positioned between the illumination element 110 and a surface to cast a particular light and shadow pattern, such as the light and shadow pattern 200 depicted in FIG. 9. The gobo panes 120 of one or more gobo sections 104 may have the same pattern, similar patterns, or may have different gobo patterns. In embodiments including a transparent or translucent window, the window may be colored to vary the aesthetic characteristics of the lighting assembly 100.

The gobo sections 104 may each include a support frame configured to retain the gobo panes 120. The support frame may include an upper retention element 114, a lower retention element 116, and one or more vertical supports 118 extending between the upper retention element 114 and the lower retention element 116. The upper retention element 114, the lower retention element 116, and the vertical supports 118 may define a retention channel 122 (FIG. 4C) to retain the gobo panes 120. When the frame is assembled, the retention channels 122 may receive one or more edges of the gobo panes 120 to retain the gobo panes 120 in the outward faces of the gobo section 104.

Figure 4C:
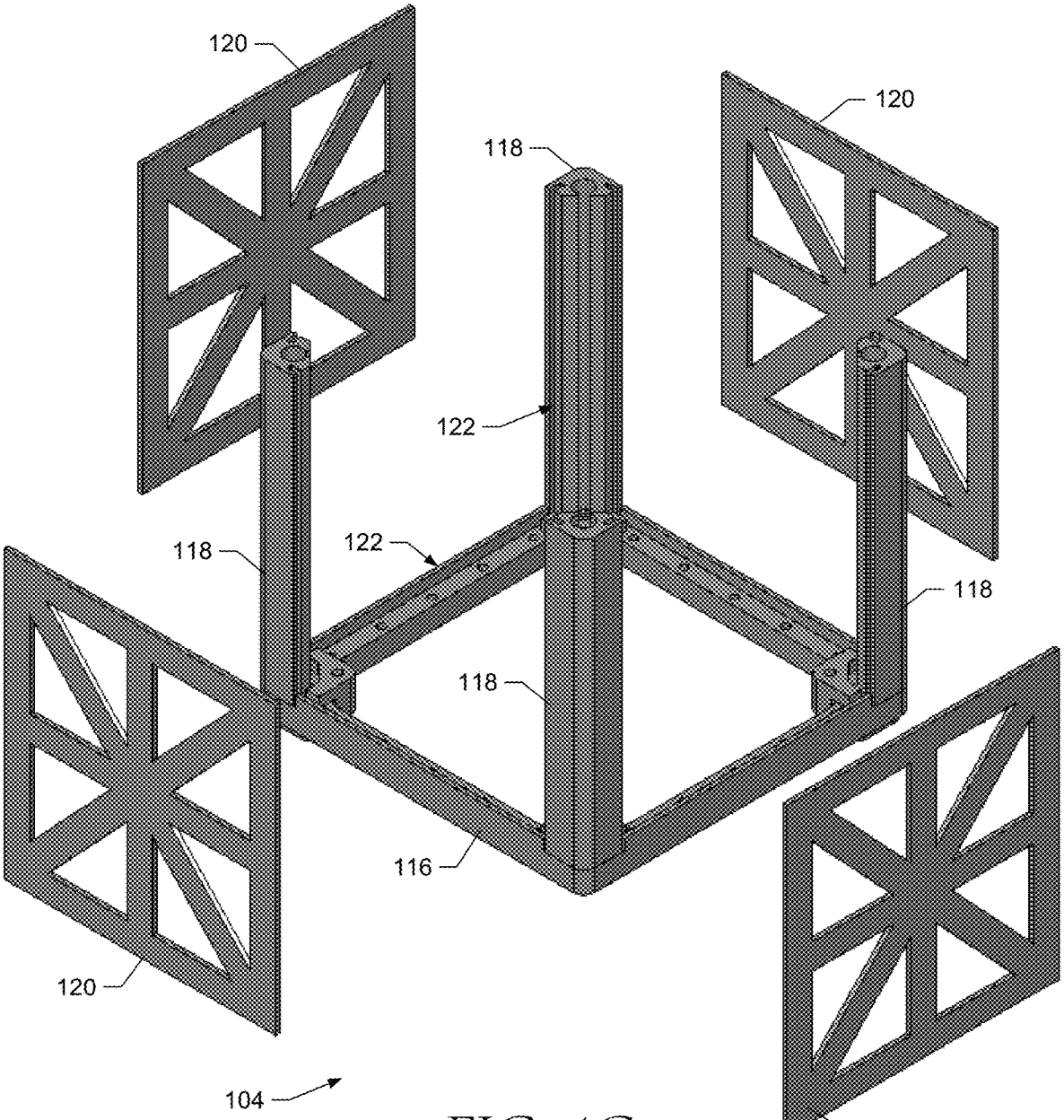

The vertical supports 118 may be coupled to the upper retention element 114 and lower retention element 116 by fasteners, adhesive, or the like. In some embodiments, at least a portion of the frame may be configured for selective disassembly. For example, the upper retention element 114 may be removed from the frame, such as by removing one or more fasteners, unfastening one or more tabs or snaps, or the like, to allow access to the gobo panes 120 (as depicted in FIG. 4C). In this embodiment, the gobo panes 120 may be changed, such as for replacement due to damage or to substitute a different pattern.

Figure 4D:
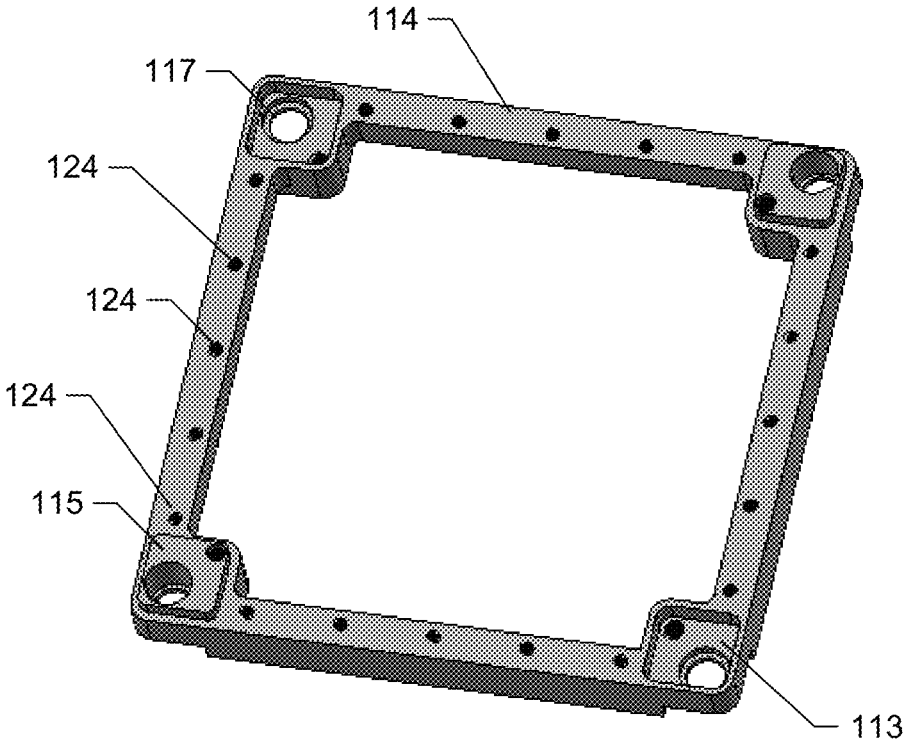

FIG. 4D is a perspective view of an example upper retention element 114 of a gobo section 104. As discussed above, the gobo sections 104 and the base 102 may include complementary alignment couplings. In the depicted example, the upper retention element 114 includes four such alignment couplings, namely two receptacle couplings 113 and two projection couplings 115 disposed diagonally at opposing corners. It will be appreciated that the base 102 may include couplings substantially similar to the upper face of the upper retention element 114. Similarly, the bottom side of the lower retention elements 116 may include may include complementary couplings, such as to enable stacking of the gobo sections 104 upon the base 102.

The receptacle couplings 113 and the projecting couplings 115 may be interference fit, such that friction maintains the connection between the couplings, without the need for additional fasteners. Advantageously, lack of fasteners between gobo sections 104 and/or the base 102 enables the gobo sections to be removed, rearranged, or additional gobo sections added to achieve the desired height or pattern, without use of tools, such as screwdrivers or the like.

Referring also to FIGS. 2 and 3, the base 102, upper retention element 114, and/or lower retention element 116 may include one or more mounting points 124 enabling mounting of the lighting bracket 112 in one or more positions. The mounting points 124 may be apertures configured to receive a fastener therethrough, or may be a projection or aperture configured to mate with a complementary projection or aperture of the lighting bracket 112.

Figure 5:
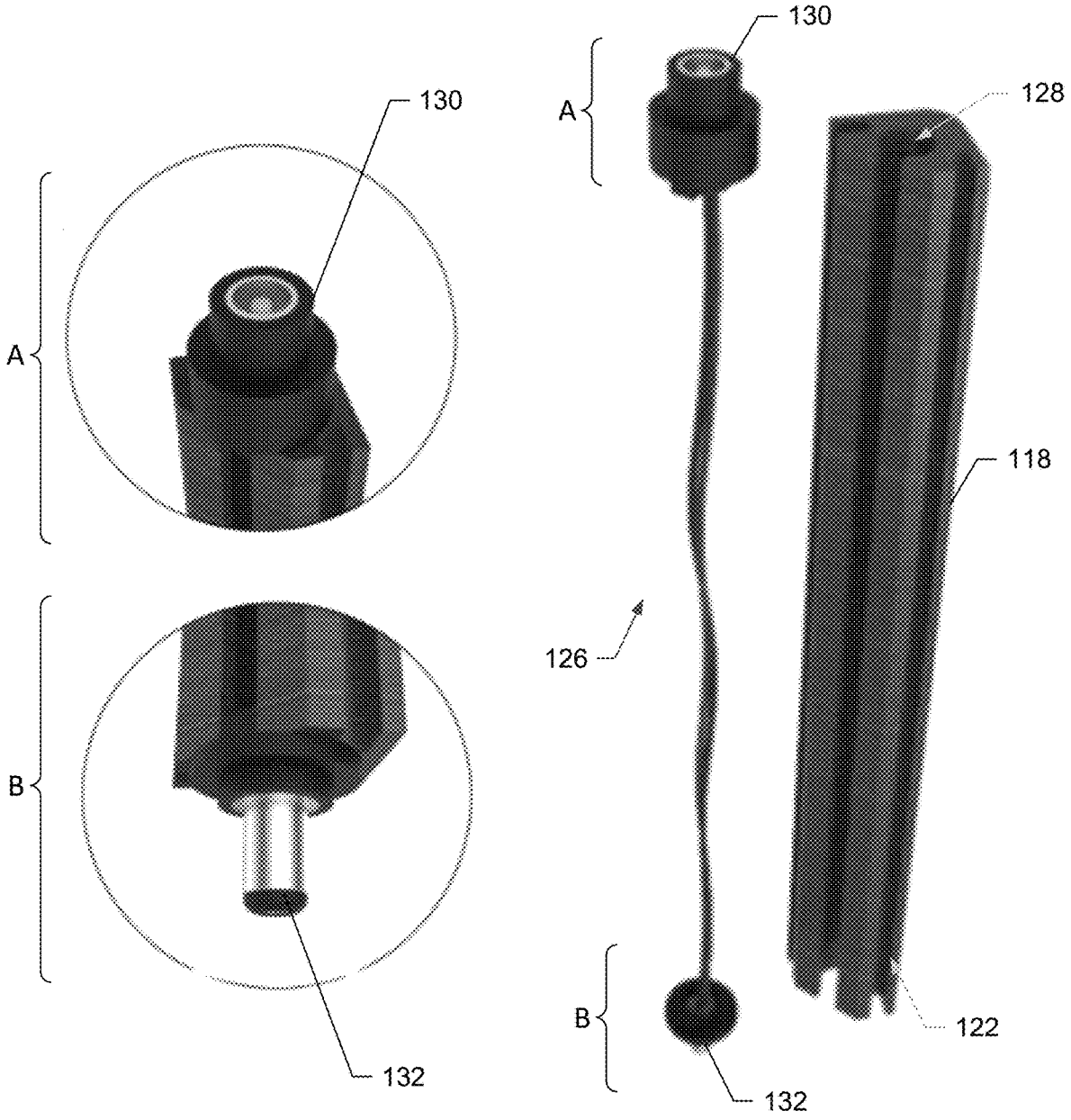
FIG. 5 illustrates an electrical cable and vertical support according to an example embodiment.

In an example embodiment, the gobo sections include an integral electrical cable 126, as depicted in FIG. 5. The electrical cable 126 may be disposed at least partially within the frame, such as adjacent to or within the vertical supports 118. For example, a cable channel 128 may be defined in one or more of the vertical supports 118 to retain the electrical cable 126. The cable channel 128 may desirably limit the visibility of the electrical cables 126 which may otherwise be unsightly or interfere with the shadow cast by the gobo panes 120.

The electrical cables 126 may include electrical connectors at each end to enable electrical connections between the base 102, gobo sections 104, and/or illumination elements 110. The electrical connectors may include a socket connector 130, shown in detail A and a plug connector 132, shown in detail B. In the depicted example, the electrical connectors are 12 VDC couplings. However, one of ordinary skill in the art would immediately appreciate that any suitable electrical connector may be substituted based on the power supply and/or the requirements of the illumination elements 110 of the particular embodiment.

In some embodiments, the upper retention element 114 or the lower retention element 116 may include additional electrical cabling extending to additional electrical connections, such as in a parallel configuration, such that multiple electrical connections may be made at each gobo section 104, e.g. multiple illumination elements 110.

In an example embodiments, the electrical connectors may project farther than the ends of the vertical support 118 and through an aperture 117 (FIG. 4D) of the upper retention element 114 or the lower retention element 116. The aperture 117 may be aligned with the socket connector 113 or the plug connector 115, such that stacking of the gobo sections 104 connects the electrical connectors 130, 132, which are integral to the complementary couplings 113, 115 of the gobo sections 104.

Figure 6:
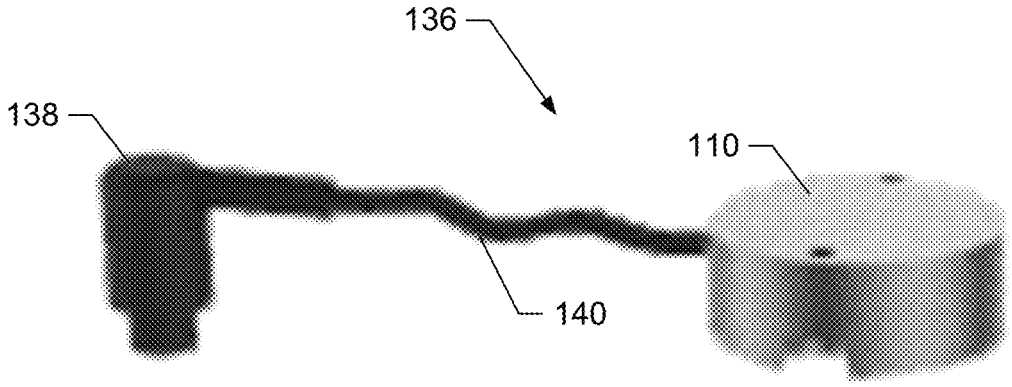
FIG. 6 illustrates an illumination assembly according to an example embodiment.

FIG. 6 illustrates an illumination assembly 136 according to an example embodiment. The illumination assembly 136 may include the illumination element 110 and a lamp jack 138 electrically connected to the illumination element 110 by a lighting cable 140. The lamp jack 138 may be mated with an electrical connector 130, 132 to provide power to the illumination element 110. In some example embodiments, the lamp jack 138 may be configured as a "pass through" connection, such that the lamp jack 138 may be connected to an electrical connector of the next lower gobo section 104 and the lamp jack 138 includes a complementary electrical connector into which another gobo section 104 may be electrically connected. Additionally or alternatively, the electrical cabling 126 may include parallel electrical connector at one or more gobo sections enabling one or more illumination assemblies 136 to be electrically connected and further gobo sections 104 to be added.

Figure 7:
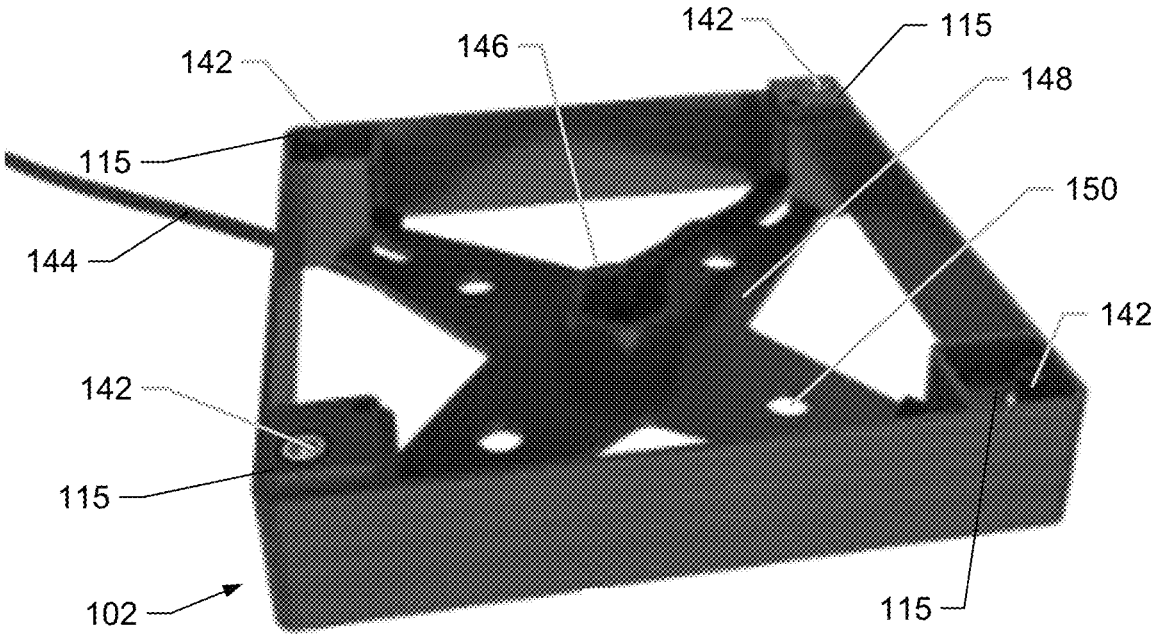
FIG. 7 illustrates an example base according to an example embodiment.

FIG. 7 illustrates an example base 102 according to an example embodiment. The base 102 may include a power supply or may be operatively coupled to a power source to supply electrical power to one or more illumination elements 110 via the gobo sections 104 stacked thereon. The power supply may include batteries, a connection to a remote power source, such as mains power, a solar cell, or the like, via a power cord 144. Typically, for example, power cord 144 may be connected to an AC transformer or DC power supply that is itself connected to mains power. The power cord 144 may enter the base 102 via a cable aperture 146. In the depicted embodiment, the cable aperture 146 is disposed centrally to the base 102 and extends through a mounting plate 148. The mounting plate 148 may be integral to, or mounted to, a bottom face of the base 102 and may include one or more mounting holes 150. The mounting plate 148 (and thus the base 102) may be mounted to a surface using fasteners through the mounting holes 150, adhesive, or other suitable methods.

The power cord 144 or other electrical cable may connect the power supply to one or more base electrical connectors 142. Similar to the electrical connectors discussed above, the base electrical connectors 142 may be disposed in, or as a portion of, the receptacle couplings 113 and/or the projection couplings 115. In some example embodiments, the base 102 may include base electrical connectors 142 in multiple, or all, of the couplings 113, 115 to facilitate a universal fit. The base electrical connectors 142 may be electrically connected in parallel, and include both plug and socket electrical connectors, similar to plug electrical connector 130 and socket electrical connector 132, discussed above in reference to FIG. 5. In this arrangement, the base 102 would connect and electrically power the gobo sections, regardless or rotation or orientation, e.g., intended top side down, when the gobo sections are stacked upon the base 102.

Many modifications and other embodiments of the invention set forth herein will come to mind to one skilled in the art to which the invention pertains having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A lighting assembly comprising:

a base configured to support the lighting assembly;

a plurality of gobo sections configured to be vertically stacked upon the base, each of said gobo sections having at least one gobo pane defining a respective light and shadow pattern to be cast;

at least one illumination element located internal to the lighting assembly, such that light from the at least one illumination element is cast through at least one of the plurality of gobo sections; and an assembly top configured to enclose a top side of an uppermost gobo section of the plurality of gobo sections, wherein the base and the plurality of gobo sections comprises first and second alignment couplings having a configuration that is complementary to each other such that the first and second alignment couplings are connected in removable fashion when the base and the plurality of gobo section are stacked.

2. The lighting assembly of claim 1, wherein each of the plurality of gobo sections further comprises an integral electrical cable.

3. The lighting assembly of claim 1 further comprising:

at least one lighting bracket configured to support the at least one illumination element, wherein the lighting bracket is configured to be mounted to the base or one of the plurality of gobo sections.

4. The lighting assembly of claim 1, wherein each gobo section of the plurality of gobo sections comprises at least one gobo pane.

5. The lighting assembly of claim 1, wherein the base further comprises a mounting plate configured to receive one or more fasteners through mounting apertures to mount the base to a surface.

6. The lighting assembly of claim 1, wherein the assembly top further comprises a top retention element configured to be mounted to the top side of the upper most gobo section of the plurality of gobo sections.

7. The lighting assembly of claim 2, wherein each of the plurality of gobo sections further comprises electrical connectors at each end of the integral electrical cable.

8. The lighting assembly of claim 7, wherein each of the gobo sections of the plurality of gobo sections comprises a support frame configured to support one or more gobo panes.

9. The lighting assembly of claim 7, wherein the base comprises a power supply electrically connected to a base electrical connector, and wherein the electrical connectors of the plurality of gobo sections are configured to electrically connect with the base electrical connector or another electrical connector of another gobo section of the plurality of gobo sections when stacked on the base or another gobo section.

10. The lighting assembly of claim 9, wherein the electrical connectors and base electrical connectors are disposed in the complementary alignment couplings.

11. The lighting assembly of claim 9, wherein the illumination element comprises a lighting cable and a lamp jack, wherein the lamp jack is configured to electrically connect at least one of the electrical connectors to provide electrical power to the illumination element.

12. The lighting assembly of claim 8, wherein the support frame is further configured to support the integral electrical cable.

13. The lighting assembly of claim 12, wherein the support frame comprises at least one vertical support and the integral electrical cable is disposed at least partially within the vertical support.

14. The lighting assembly of claim 3, wherein the at least one illumination element comprises a plurality of illumination elements and the at least one lighting bracket comprises a plurality of lighting brackets, each of the plurality of lighting brackets mounted to at least one of the plurality of illumination elements.

15. The lighting assembly of claim 4, where the at least one of gobo pane comprises a decorative pattern configured to cause a shadow of the decorative pattern to be cast on a surface when the illumination element is lighted.

16. The lighting assembly of claim 4, wherein the at least one gobo pane of at least one gobo section of the plurality of gobo sections comprises a blank configured to prevent light from passing through the at least one gobo pane.

17. The lighting assembly of claim 4, wherein each of the gobo sections of the plurality of gobo sections further comprises a support frame configured to retain the at least one gobo pane.

18. The lighting assembly of claim 15, wherein the at least one gobo pane comprises a plurality of gobo panes, and two or more of the plurality of gobo panes of a gobo section of the plurality of gobo sections comprise the same decorative pattern.

19. The lighting assembly of claim 17, wherein the support frame comprises:

a lower retention element;

an upper retention element; and a plurality of vertical supports, wherein the vertical supports extend between the lower retention element and the upper retention element.

20. The lighting assembly of claim 17, wherein the vertical supports or the upper retention element and lower retention elements defines a retention channel to retain the at least one gobo pane.

* * * * *